US007670677B2

(12) United States Patent
Usui et al.

(10) Patent No.: US 7,670,677 B2
(45) Date of Patent: Mar. 2, 2010

(54) LATENTLY CRIMPABLE CONJUGATE FIBER AND PRODUCTION METHOD OF THE SAME, AND FIBER ASSEMBLY, AND NONWOVEN

(75) Inventors: Yoshiji Usui, Kobe (JP); Shigeki Kawakami, Akashi (JP)

(73) Assignee: Daiwabo Holdings Co., Ltd., Osaka (JP)

( * ) Notice: Subject to any disclaimer, the term of this patent is extended or adjusted under 35 U.S.C. 154(b) by 837 days.

(21) Appl. No.: 10/569,666

(22) PCT Filed: Aug. 26, 2004

(86) PCT No.: PCT/JP2004/012271

§ 371 (c)(1),
(2), (4) Date: Feb. 24, 2006

(87) PCT Pub. No.: WO2005/021850

PCT Pub. Date: Mar. 10, 2005

(65) Prior Publication Data

US 2007/0014987 A1 Jan. 18, 2007

(30) Foreign Application Priority Data

Aug. 28, 2003 (JP) ..... 2003-304665

(51) Int. Cl.
*D02G 3/24* (2006.01)
*D01D 5/32* (2006.01)

(52) U.S. Cl. ..... 428/374; 428/373; 428/394; 264/172.11; 264/172.14; 264/172.17

(58) Field of Classification Search ..... None
See application file for complete search history.

(56) References Cited

U.S. PATENT DOCUMENTS 5,171,633 A 12/1992 Muramoto et al.
5,352,518 A 10/1994 Muramoto et al.
6,274,237 B1 8/2001 Nakajima et al.

FOREIGN PATENT DOCUMENTS

| | | | |
|---|---|---|---|
| JP | 2-53916 | | 2/1990 |
| JP | 2-191720 | | 7/1990 |
| JP | 9-291420 | | 11/1997 |
| JP | 2000178832 A | * | 6/2000 |
| JP | 2001-40531 | | 2/2001 |
| JP | 2001-140158 | | 5/2001 |
| JP | 2004-124351 | | 4/2004 |
| TW | 167679 | | 9/1991 |
| TW | 194514 | | 11/1992 |

OTHER PUBLICATIONS

JP2000178832 machine translation.*
"Ethylene Polymer", *Concise Encyclopedia of Polymer Science and Engineering*, pp. 102-106, Sep. 20, 1994, English abstract.
*Plastic Data Book*, Editorial Department of "Plastics" of Asahi Kasei Amidas Co., Ltd., pp. 338-339, 342-343, 346-347, Dec. 1, 1999, and English abstract.

* cited by examiner

*Primary Examiner*—Jill Gray
(74) *Attorney, Agent, or Firm*—Hamre, Schumann, Mueller & Larson, P.C.

(57) ABSTRACT

A latently crimpable conjugate fiber is constructed using a first component containing an ethylene-α-olefin copolymer polymerized with a metallocene catalyst and a second component formed from a thermal plastic polymer having a melting point $T_2$ higher than a melting point $T_1$ of the first component, such that the first component is exposed with an exposed length of at least 20% relative to a peripheral length of the fiber, and which fiber has a single fiber dry heat shrinkage percentage of at least 50%, which is determined according to JIS-L-1015 (dry heat shrinkage percentage) at 100° C. under an initial tension of 0.018mn/dtex (2mg/d) for 15 minutes and a single fiber dry heat shrinkage percentage of at least 15%, which is determined under the same condition under an initial tension of 0.450mN/dtex (50mg/dtex) for 15 minutes. The latently crimpable conjugate fiber develops crimps and has thermal adhesiveness at a low temperature.

8 Claims, No Drawings

LATENTLY CRIMPABLE CONJUGATE FIBER AND PRODUCTION METHOD OF THE SAME, AND FIBER ASSEMBLY, AND NONWOVEN

TECHNICAL FIELD

The present invention relates to a latently crimpable conjugate fiber which is excellent in shrinkability and crimp developing during thermal process and has a good thermal adhesiveness. Further, the present invention relates to a fiber assembly with excellent shrinkability and stretchability wherein the latently crimpable conjugate fibers are employed.

BACKGROUND ART

Various latently crimpable conjugate fibers used for producing a stretch nonwoven have been proposed. For example, Japanese Patent Kokai (Laid-Open) Publication No. 2-191720(A) (Patent Literature 1) proposes a conjugate fiber wherein polypropylene having a Q value of less than 5 and a melt flow rate of from 15 g/10 min to 200 g/10 min is a first component and ethylene-propylene having a melting temperature of from 133° C. to 145° C. is a second component and these components are disposed in a side-by-side structure, or an eccentric sheath-core structure in which the first component is a core and the second component is a sheath. Japanese Patent Kokai (Laid-Open) Publication No. 2-53916 (A) (Patent Literature 2) proposes a conjugate fiber wherein a first component is a high-density polyethylene having a density of not less than 0.958 g/cm$^3$ and a second component is a polybutylene terephthalate and these component are disposed in a side-by-side structure, or an eccentric sheath-core structure in which the first component is a sheath and the second component is a core. Japanese Patent (Laid-Open) Publication No. 2001-40531(A) (Patent Literature 3) proposes an eccentric sheath-core conjugate fiber wherein a first component is a propylene copolymer having a specific melting point and a second component is polyethylene which is disposed as a sheath.

Patent Literature 1:

Japanese Patent Kokai (Laid-Open) Publication No. 2-191720(A)

Patent Literature 2:

Japanese Patent Kokai (Laid-Open) Publication No. 2-53916(A)

Patent Literature 3:

Japanese Patent (Laid-Open) Publication No. 2001-40531 (A)

DISCLOSURE OF INVENTION

Problems to Be Solved by Invention

The conventional latently crimpable conjugate fibers leave room for improvement from a practical viewpoint. For example, the conjugate fiber proposed in Patent Literature 2 are intended to develop crimps using unbalance of the sectional structure wherein the centers of two components do not match and the fiber does not have sufficient crimp-developing property. For this reason, a fiber web containing the fibers does not shrink well. Although the conjugate fibers proposed in Patent Literatures 1 and 3 have a high crimp-developing property, their crimp-developing property at a low temperature is low and therefore it is necessary to process a fiber web at a high temperature when crimps are desired to be sufficiently developed. Some conventional latently crimpable conjugate fibers possibly exhibit a high crimp-developing property at a low temperature, but the fiber may not reach a state in which the fibers are fully crimped (that is, a state in which crimping does not further proceed). Such a conjugate fiber has a disadvantage that the processability such as cardability upon production of a nonwoven is bad.

As described above, the latently crimpable conjugate fibers which have been proposed is required to be further improved as to a low-temperature processability. The present invention is made considering this situation, and the object of the invention are to provide a latently crimpable conjugate fiber which has a high latently crimpability and develops crimps fully by a low-temperature and short-time process, and is excellent in processability such as cardability upon production of a nonwoven.

MEANS TO SOLVE PROBLEMS

The inventors considered that the problems would be solved by making a component that contributes to a shrink developing of a fiber, that is a component which solely shrinks when heated, from an ethylene-α-olefin copolymer and constructing a conjugate fiber wherein this component occupies a part of a surface or an entire surface of the fiber. As a result, they have found that a conjugate fiber which satisfies the following conditions has favorable crimp-developing property at a low temperature and it can be used as a thermal bonding fiber.

That is, a latently crimpable conjugate fiber of the present invention is a conjugate fiber which includes a first component containing an ethylene-α-olefin copolymer and a second component formed from a thermal plastic polymer which has an after-spinning melting point $Tf_2$ that is higher than an after-spinning melting point $Tf_1$ of the first component, wherein the first component is exposed with an exposed length of not less than 20% relative to a peripheral length of the fiber, and which fiber has:

(1) a single fiber dry heat shrinkage percentage of at least 50%, which is determined according to JIS-L-1015 (dry heat shrinkage percentage) at a temperature of 100° C. under an initial tension of 0.018 mN/dtex (2 mg/d) for a time of 15 minutes; and (2) a single fiber dry heat shrinkage percentage of at least 15%, which is determined according to JIS-L-1015 (dry heat shrinkage percentage) at a temperature of 100° C. under an initial tension of 0.450 mN/dtex (50 mg/d) for a time of 15 minutes.

The conjugate fiber whose dry heat shrinkage percentage determined under the two conditions are at least above-described specific values respectively, are favorably and fully crimped at a low temperature (specifically about 100° C.-120° C.). Further, the fiber exhibits favorable heat adhesiveness since the ethylene-α-olefin copolymer which is the first component occupies at least a part of the surface of the fiber. In this latently crimpable conjugate fiber, the ethylene-α-olefin copolymer which highly shrinks at about 100° C. is used as a shrinkable component and a component whose shrinkability is lower than that of the ethylene-α-olefin is used as the second component. This constitution has not been seen in the prior art.

The latently crimpable conjugate fiber of the present invention is preferably produced according to a method wherein a first component containing an ethylene-α-olefin copolymer of which a before-spinning melting point $T_1$ is in a range of 100° C. to 125° C., a density is in a range of 0.90 g/cm$^3$ to 0.93 g/cm$^3$, a Q value is in a range of 1.5 to 8 and a before-spinning melt index is in a range of 1 g/10 min to 15 g/10 min and a second component consisting of a thermal plastic polymer of which a before-spinning melting point $T_2$ is higher than $T_1$ are composite-spun such that the first component is exposed with an exposed length of not less than 20% relative to the peripheral length of the fiber. It is possible to obtain the latently crimpable conjugate fiber which is excellent in crimp-developing property at a low temperature by using the ethylene-α-olefin copolymer which has a specific melting point, a specific density, a specific Q value and MI.

Further, the latently crimpable conjugate fiber of the present invention can be identified as a latently crimpable conjugate fiber which includes a first component containing an ethylene-α-olefin copolymer and a second component consisting of a thermal plastic polymer of which an after-spinning melting point $Tf_2$ is higher than an after-spinning melting point $Tf_1$ of the first component, wherein the first component is exposed with an exposed length of not less than 20% relative to the peripheral length of the fiber, and which fiber exhibits a web-area shrinkage percentage of not less than 80% when a web having a mass per unit area of 30 g/m$^2$ is formed from the conjugate fibers and is subjected to a thermal treatment (specifically a hot air-through treatment) at 100° C. for 12 seconds.

A fiber assembly of the present invention is characterized in that the latently crimpable conjugate fiber or the latently crimpable conjugate fiber produced by the above-described production method is contained in an amount of not less than 20 mass %, and the latent crimps are developed in the latently crimpable conjugate fiber. This fiber assembly is excellent in stretchability or shrinkability since it is obtained by developing the latent crimps at a low temperature, and it has a good feeling since it is not exposed to a high temperature. Further, this fiber assembly has favorable thermal adhesiveness since the first component which is exposed on the surface of the latently crimpable conjugate fiber is the ethylene-α-olefin copolymer. Therefore, this fiber assembly is suitable for constituting a laminate (or a layered product) wherein a plurality of the fiber assemblies are stacked or another sheet member is stacked on the fiber assembly and they are integrated by means of thermal bonding of the latently crimpable conjugate fiber. The fiber assembly of the present invention is preferably a nonwoven.

EFFECT OF INVENTION

The latently crimpable conjugate fiber of the present invention is constructed such that the thermally-shrinkable ethylene-α-olefin copolymer serves to be the first component and the first component occupies at least a part of the surface of the fiber, and it exhibits a high dry heat shrinkage percentage at 100° C. In other words, this latently crimpable conjugate fiber has a property that it is facilitated to develop crimps at a low temperature. Therefore, this latently crimpable conjugate fiber develops crimps highly and reaches the state in which crimps are fully developed at a low thermal process temperature. Further, this fiber also serves as a thermal bonding fiber since a part of the surface of the fiber is occupied by the ethylene-α-olefin copolymer.

The fiber assembly wherein the latently crimpable conjugate fibers of the present invention are used is one in which highly-developed crimps are present in the latently crimpable conjugate fibers through a thermal treatment. Such a fiber assembly is obtained by processing a fiber web containing the latently crimpable conjugate fibers of the present invention at a relatively low temperature (about 100° C. to 120° C.). For this reason, this fiber assembly has a characteristic that a soft feeling is maintained after the thermal treatment, in addition to a property obtained by development of the crimps (for example, stretchability). Further, since the latently crimpable conjugate fiber of the present invention has thermal adhesiveness, a laminate wherein layers are integrated by thermal bonding of the fibers can be easily obtained by stacking a plurality of the fiber assemblies or stacking this fiber assembly on another sheet material (for example, a paper) followed by a thermal treatment (for example, a heat seal process).

BEST MODE FOR CARRYING OUT THE INVENTION

In the latently crimpable conjugate fiber of the present invention, the first component contains an ethylene-α-olefin copolymer which has thermal shrinkability. Herein, the ethylene-α-olefin copolymer is a copolymer consisting of ethylene and an α-olefin whose carbon number is from 3 to 12. Specifically, the α-olefins whose carbon number is from 3 to 12 include propylene, butene-1, pentene-1, 4-methyl pentene-1, hexene-1, heptene-1, octene-1, nonene-1, decene-1, dodecene-1 and a mixture thereof. Of these, propylene, butene-1, 4-methyl pentene-1, hexene-1, 4-methyl hexene-1, and octene-1 are particularly preferable, and butene-1 and hexene-1 are further preferable. An α-olefin content in the ethylene-α-olefin copolymer constituting the latently crimpable conjugate fiber of the present invention is preferably in a range of 1 mol % to 10 mol % and more preferably in a range of 2 mol % to 5 mol %. When the α-olefin content is small, the softness of a nonwoven is deteriorated when the nonwoven is formed from the latently crimpable conjugate fibers of the present invention. When the α-olefin content is large, the crystallinity is deteriorated which may cause fusion bond between fibers upon fiber making. What is called as a linear low-density polyethylene (which is abbreviated as "LLDPE") in the field of synthetic fiber production is also included in the ethylene-α-olefin copolymer referred in the present invention and it is preferably used in the present invention.

More specifically, the ethylene-α-olefin copolymer used in the first component is an ethylene-α-olefin copolymer of which a density is in a range of 0.90 g/cm$^3$ to 0.93 g/cm$^3$ and a melting point (before spinning) $T_1$ is in a range of 100° C. to 125° C. and a Q value is in a range of 1.5 to 8. The ethylene-α-olefin copolymer whose melting point $T_1$ and Q value are in these ranges has a high thermal shrinkability and confers favorable crimp-developing property to the conjugate fiber of the present invention. The Q value is preferably in a range of 1.5 to 3.5 and more preferably in a range of 2 to 3.2 and still more preferably in a range of 2 to 3. It is particularly preferable to use, as the first component, an ethylene-α-olefin copolymer of which the density is in a range of 0.91 g/cm$^3$ to 0.925 g/cm$^3$, $T_1$ is in a range of 103° C. to 122° C. and the Q value is in a range of 2 to 3. It should be noted that when the before-spinning melting point of the ethylene-α-olefin copolymer is determined from a curve for heat of fusion which curve is obtained by DSC, two or more peaks may appear in the curve. In that case, the temperature at which a maximum peak is shown is determined as a fusion peak temperature, that is, a melting point. This is applied to other resins which constitute the present invention.

When the first component contains a component other than the ethylene-α-olefin copolymer, the first component preferably contains the ethylene-α-olefin copolymer in an amount of at least 50 mass %. When the proportion of the ethylene-α-olefin copolymer is less than 50 mass%, the thermal shrinkability of the first component may be insufficient. The first component preferably consists substantially of only the ethylene-α-olefin copolymer. Herein, the term "substantially" is used considering that the proportion of the ethylene-α-olefin copolymer is not completely 100 mass % when an additive such as a stabilizer is contained.

In general, the melt index (MI) of the ethylene-α-olefin copolymer is preferably in a range of 1 g/10 min to 20 g/10 min considering spinning property. The crimp-developing property of the latently crimpable conjugate fiber tends to be increased as the MI of the first component is lower. Further, the crimp-developing property of the latently crimpable conjugate fiber tends to be increased as a difference between the MI of the first component and the MI (or MFR) of the second component is larger. When the difference, however, is too large, fiber making is difficult. For this reason, the MI of the ethylene-α-olefin copolymer is preferably selected so that the difference between the MI of the copolymer and the melt index or the melt flow rate of the second component is from 5 to 30. Herein, the melt index (MI) is determined according to JIS-K-7210 (condition: 190° C., load of 21.18N (2.16 kg)). The melt flow rate corresponds to a melt index determined at 230° C.

More specifically, when the second component has the MFR of about 15 to about 30, the MI of the ethylene-α-olefin copolymer is preferably in a range of 1 g/10 min to 15 g/10 min, more preferably in a range of 3 g/10 min to 15 g/10 min, and still more preferably in a range of 3 g/10 min to 10 g/10 min.

The ethylene-α-olefin copolymer having the above-described density, the melting point, the Q value and the MI includes an ethylene-α-olefin copolymer (specifically, a linear low density polyethylene resin) which is polymerized with a metallocene catalyst. More specifically, UMERIT EX3335, UMERIT EX3322, UMERIT ZM064, and UMERIT EX3224 which are manufactured by Ube Industries Ltd. and Karnel KF480 manufactured by Japan Polyethylene Corporation, and Hamorex NH725A manufactured by Japan Polyethylene Corporation may be used as the first component. Alternatively, the first component may be a mixture of the ethylene-α-olefin copolymer polymerized with the metallocene catalyst and an ethylene-α-olefin copolymer polymerized with a Ziegler-Natta catalyst, as long as the density, the melting point, and the Q value are in the above-described ranges.

The after-spinning melting point $Tf_1$ of the first component is preferably in a range of 105° C. to 125° C., and more preferably in a range of 110° C. to 120° C.

In the latently crimpable conjugate fiber of the present invention, the second component consists of a thermal plastic resin having an after-spinning melting point $Tf_2$ that is higher than the after-spinning melting point $Tf_1$ of the first component. $Tf_2$ is preferably higher by 10° C. than $Tf_1$, and more preferably by 15° C. than $Tf_2$. When a difference between $Tf_1$ and $Tf_2$ is small, favorable crimp developing may not be achieved.

As the second component, for example, a polyester resin such as polyethylene terephthalate, polybutylene terephthalate, polytrimethylene terephthalate, and a copolymer thereof; a polyamide resin such as nylon 6, nylon 66, and a copolymer thereof; a polyolefin resin such as polypropylene and polymethyl pentene may be exemplified. The second component may be a mixture of two or more resins selected from these resins. Of these, it is particularly preferable to use polypropylene as the second component from the viewpoints of spinning property, the crimp-developing property of the fiber and the shrinkability of the resin itself. It should be noted that the shrink degree of the second component is smaller than that of the first component, if the second component shrinks. Therefore, the second component confers rigidity to the latently crimpable conjugate fiber of the present invention and serves to ensure the cardability of the fiber.

Polypropylene used as the second component preferably has a Q value of not greater than 4, more preferably a Q value of not greater than 3.5, and still more preferably a Q value of not greater than 3.2. As the Q value is smaller, the crimp-developing property of the resultant latently crimpable conjugate fiber tends to be more favorable.

Further, polypropylene used as the second component preferably has an MFR in a range of 10 g/10 min to 30 g/10 min. As described above, the MFR is determined according to JIS-K-7210 (conditions: 230° C., load of 21.18N (2.16 kg)). When the MFR is less than 10 g/10 min, drawability may be deteriorated. When the MFR is greater than 30 g/10 min, spinnability may be deteriorated.

The polypropylene having the above-described Q value and MFR include, for example, SA03D and SA2D manufactured by Japan Polypropylene Corporation.

Alternatively, the second component may be a polyester resin. When the second component is the polyester resin, it is preferable to use a mixture of two or three kinds of polyester resins selected from polyethylene terephthalate (PET), polybutylene terephthalate (PBT) and polytrimethylene terephthalate (PTT) since the shrinkability of the fiber is improved. When PET is mixed with PBT and/or PTT, the mixing ratio (mass ratio) of PET to a polyester resin other than PET (i.e. PBT and/or PBT), that is, PET: the polyester resin other than PET is preferably 30:70 to 80:20, and more preferably 40:60 to 70:30. In the case where PET is mixed with the polyester resin other than PET and the mixing ratio of the polyester resin other than PET is small, the shrinkability of the fiber tends to be reduced. When the mixing ratio of the polyester resin other than PET is large, the rigidity of the fiber itself is small and cardability of the fiber tends to be lowered.

The latently crimpable conjugate fiber of the present invention preferably has a sectional structure wherein the first component is exposed with an exposed length of not less than 20% relative to the peripheral length of the fiber. As such a sectional structure, an eccentric sheath-core section wherein the first component is a sheath component and the second component is a core component and the center position of the second component (the core component) is shifted from the center position of the fiber, and a side-by-side section may be exemplified. This sectional structure makes it possible to obtain a conjugate fiber which is excellent in shrinkability and crimp-developing property.

When the latently crimpable conjugate fiber is the eccentric sheath-core conjugate fiber, an eccentricity of the second component is preferably in a range of 20% to 60% and more preferably in a range of 30% to 50%. The eccentricity is defined by a following formula:

$$\text{Eccentricity (\%)} = \frac{\text{Distance between center of single fiber and center of core component}}{\text{Radius of single fiber}} \times 100$$

When the eccentricity is less than 20%, sufficient shrinkability upon a low-temperature process is not obtained, and therefore crimp developing property is not obtained. When the eccentricity is over 60%, balance between the first component and the second component is extremely bad with respect to a resin ratio, whereby three-dimensional crimps are highly developed at a raw fiber stage and it difficult to prepare a web using a high-speed card (that is, high-speed cardability is deteriorated).

As described above, the latently crimpable conjugate fiber of the present invention can be obtained as a favorable embodiment by adjusting particularly the MI of the ethylene-α-olefin copolymer and the eccentricity. In other words, by producing the fiber adjusting these factors appropriately, it is possible to obtain the fiber which is excellent in processability as cardability, and develops crimps and shrinks at a high area shrinkage percentage when a web formed from the fibers is subjected to a thermal treatment.

When the latently crimpable conjugate fiber is a side-by-side conjugate fiber, the exposure ratio of the first component relative to the peripheral length of the fiber is preferably at least 20%, more preferably at least 30%, and still more preferably at least 50%. When the exposure ratio is less than 20%, the shrinkability may be insufficient, and a favorable thermal adhesiveness may not be ensured if this fiber is used as the thermal bonding fiber. Considering the cardability, the exposure ratio is preferably at least 50% and the exposure ratio is suitably 100% in particular. It should be noted that when the exposure ratio is 100%, the fiber becomes the conjugate fiber having substantially the eccentric sheath-core section.

The composite ratio of the first component to the second component is preferably in a range of 3:7 to 7:3 by volume. The more preferable range of the volume ratio is from 4:6 to 6:4. When the ratio of the first component is less than three, the shrinkability may be insufficient. When the ratio of the first component is greater than seven, the high-speed cardability is deteriorated whereby the productivity is lowered.

The latently crimpable conjugate fiber of the present invention is a conjugate fiber including the first component containing the ethylene-α-olefin copolymer and the second component formed from the thermal plastic polymer which is a high melting point component, in which fiber a single fiber dry heat shrinkage percentage determined according to JIS-L-1015 (dry heat shrinkage percentage) is at least 50%, preferably at least 75%, more preferably at least 80% and most preferably at least 85%, when measured at a temperature of 100° C. under an initial tension of 0.018 mN/dtex (2 mg/d) for a time of 15 minutes; and a single fiber dry heat shrinkage percentage is at least 15% and preferably at least 20% when measured under the same conditions except for an initial tension of 0.450 mN/dtex (50 mg/d).

The initial tension is a load which is applied before and after heating when a fiber length is determined. In the case of the initial tension of 0.018 mN/dtex (2 mg/d), the fiber length after heating is determined with the developed crimps kept since the tension is small. Therefore, this single fiber dry heat shrinkage percentage can be said to be a measure which shows a degree of shrinkage (that is a degree of apparent shrinkage) due to the development of three-dimensional crimps. On the other hand, in the case of the initial load of 0.450 mN/dtex (50 mg/d), the fiber is pulled strongly by the tension and the fiber length after heating is determined with the developed three-dimensional crimps of the fiber relatively "stretched." In other words, this single fiber dry heat shrinkage percentage indicates the degree of shrinkage of the fiber itself due to heating. It is considered that the latently crimpable conjugate fiber of the present invention has excellent three-dimensional-crimp-developing property and develops crimps well even at a low temperature during a thermal process, since the single fiber dry heat shrinkage percentages determined under two initial tensions satisfy the above-described ranges. That is, energy saving is achieved in the nonwoven production and a high-speed production is made possible because the single fiber dry heat shrinkage percentage at 100° C. is high. Herein, the "low temperature" means a temperature in a range of about 100° C. to about 120° C. The latently crimpable conjugate fiber of the present invention develops the latent crimps even at such a low temperature such that an area shrinkage percentage of a web (mass per unit area: 30 g/m$^2$) is 80% or more.

Presence or absence of practicability of the latently crimpable conjugate fiber of the present invention may be determined, for example, by measuring a single fiber dry heat shrinkage percentage according to JIS-L-1015 (dry heat shrinkage percentage) at a temperature of 120° C. under an initial tension of 0.450 mN/dtex for a time of 15 minutes. When the single fiber dry heat shrinkage percentage under this condition is, for example, about 50%, and preferably about 60%, the fiber develops crimps sufficiently at a temperature of from about 110° C. to about 120° C. even if the single fiber dry heat shrinkage percentage is about 50% when measured at a temperature of 100° C. under an initial tension of 0.018 mN/dtex (2 mg/d) for a time of 15 minutes.

A percentage of crimp determined according to JIS-L-1015 of the latently crimpable conjugate fiber of the present invention is preferably in a range of 8% to 17% and more preferably in a range of 11% to 15%. When the percentage of crimp is over 17%, bad openability, winding on a cylinder or a cloudy tends to be seen while the fiber passes the high-speed card, since the three-dimensional crimps are highly developed at a raw fiber stage. When the percentage of crimp is less than 8%, the cardability of the fiber is deteriorated and the fiber is not suitable for producing the nonwoven or the like. The percentage of crimp is an important factor which determines the high-speed cardability of the fiber and it may be adjusted by a draw ratio, a number of mechanical crimp, a percentage of mechanical crimp, an annealing treatment temperature and so on. That is, the present invention makes it possible to construct a conjugate fiber having high crimp-developing property such that the percentage of crimp at a raw fiber stage is in a range of about 8% to 17%. This is a characteristic which has been difficult to be achieved by the conventional latently crimpable conjugate fiber.

The latently crimpable conjugate fiber of the present invention may be produced by, for example, the following procedures. Firstly, an ethylene-α-olefin copolymer whose melting point $T_1$ is in a range of 100° C. to 125° C. and a thermal plastic resin whose melting point $T_2$ is higher preferably by at least 40° C. than $T_1$ are prepared. Next, a spun filament with a fineness of not less than 3 dtex and not greater than 50 dtex is produced by composite-spinning the ethylene-α-olefin copolymer as a first component and the thermal plastic resin having the high melting point as a second component using a conventional melt-spinning machine. When the fineness of the spun filament is less than 3 dtex, filament break may occur, which reduces the productivity of fiber. When the spun filament fineness is over 50 dtex, the filament cannot be drawn sufficiently and a filament with a uniform fineness cannot be obtained because of necking.

Next, the spun filament is subjected to a drawing treatment using a conventional drawing machine in order to obtain a drawn filament. The drawing treatment is preferably conducted setting a drawing temperature at a temperature in a range of 60° C. to (T1-10)° C. When the second component is polypropylene, the drawing temperature is preferably set at a temperature in a range of 80° C. to 100° C. The draw ratio is preferably 2 times or more, and more preferably from 3 times to 5 times. The drawing method may be any of a wet drawing method wherein the drawing is conducted in warm water or hot water, and a dry drawing method.

The condition of drawing treatment is one of factors which determine the single fiber elongation of a resultant fiber and the single fiber elongation may be one of factors which determine the crimp-developing property and stability of the developed crimp. For example, when fibers are compared, which are produced using the same or similar polymer under the same fiber-producing condition except for the condition of the drawing treatment, the difference between the conditions of the drawing treatments, that is, the difference between the single fiber elongations may give effect on the crimp-developing property and the stability of the developed crimps. When the drawing temperature is below 60° C., the polymers which constitute the fiber (that is the first component and the second component) are not stabilized and the crimps may tend to be developed at a raw stack stage, or the developed crimps in the fiber assembly may be unstable. When the drawing temperature is over 95° C., the crimps are difficult to be developed. When the draw ratio is less than 2 times, the single fiber elongation may be small and favorable fiber-developing property may not be obtained. On the other hand, when the draw ratio is over 5, the crimps are easily developed at a raw stock stage, and the high-speed cardability of the fiber may not be deteriorated.

A predetermined amount of fiber treatment agent is applied to the resultant drawn filament and then mechanical crimps are given to the filament with a crimper (a crimp-giving machine). The number of crimp is preferably in a range of 12 peaks/25 mm to 19 peaks/25 mm. When the number of crimp is less than 12 peaks/25 mm, the high-speed cardability of the fiber is deteriorated since winding on a cylinder and fly tend to occur in the card. Further, a web strength which indicates a degree of entanglement of fibers is low, and trouble tends to occur in the carding process. When the number of crimp is more than 19 peaks/25 mm, uniformity such as nep and cloudy tends to generate due to bad openability of the fiber in the carding process. The number of crimp is more preferably in a range of 13 peaks/25 mm to 17 peaks/25 mm and still more preferably in a range of 14 peaks/25 mm to 17 peaks/25 mm.

After forming the crimps, the filament is subjected to an annealing treatment at a temperature in a range of 40° C. to 100° C. for a several seconds to about 30 minutes. When the annealing treatment is conducted after the fiber treatment agent is applied, the annealing treatment is preferably conducted at an annealing temperature in a range of 50° C. to 80° C. for a treatment time of at least 5 minutes in order that the fiber treatment agent is dried at the same time. When the annealing treatment is conducted at a temperature in the above-described range, the crystallization of the conjugate fiber is suppressed in order to suppress the development of the three-dimensional crimp to a low level at a raw material stage, and thereby it is possible to adjust the percentage of crimp and the single fiber dry heat shrinkage percentage so as to make them fall in desired ranges.

After finishing the annealing treatment, the filament is cut so that a fiber length is from 30 mm to 100 mm. The latently crimpable conjugate fiber may be used in a form of long fiber, if necessary.

When a web is formed from the latently crimpable conjugate fibers of the present invention, the web shows a thermal shrinking behavior different from that of a web formed from the conventional fibers, and the fiber of the present invention can be identified by this thermal shrinking behavior. Specifically, the latently crimpable conjugate fiber of the present invention can be identified as a latently crimpable conjugate fiber which includes a first component containing an ethylene-$\alpha$-olefin copolymer and a second component consisting of a thermal plastic polymer of which melting point $T_2$ is higher than the melting point $T_1$ of the first component, wherein the first component is exposed with an exposed length of not less than 20% relative to a peripheral length of the fiber, and which fiber exhibits a web-area shrinkage percentage of at least 80% when a web having a mass per unit area of 30 g/m$^2$ is formed from the conjugate fibers and is subjected to a thermal treatment at 100° C. for 12 seconds. In other words, the latently crimpable conjugate fiber of the present invention develops the latent crimps well at a relatively low temperature within a short time. Further, the latently crimpable conjugate fiber of the present invention has a characteristic that the web is less shrinkable after the web has been subjected to the thermal treatment as described even if the thermal treatment is continued. Herein, the thermal treatment refers to a so-called "hot air-through method."

In the case where the latently crimpable conjugate fiber of the present invention is identified by the thermal shrinking behavior of the web as described above, the latently crimpable conjugate fiber of the present invention is preferably identified as one which exhibits a ratio of a shrinkage percentage in a longitudinal direction (that is, machine direction) of the web to a shrinkage percentage in a cross direction of the web of at least 0.6. As described above, the difference between the shrinkage percentage in the longitudinal direction of the web and the shrinkage percentage in the cross direction of the web becomes small compared with that of a web formed from the conventional fibers, since the latently crimpable conjugate fiber of the present invention can develop crimps without being constrained before the first component softens or melts.

The latently crimpable conjugate fiber of the present invention forms a fiber assembly which is excellent in stretchability and shrinkability and has favorable feeling when it is contained in the fiber assembly in an amount of not less than 20 mass % and the latent crimps are developed. The fiber assemblies include a woven fabric, a knitted fabric, and a nonwoven.

Next, a specific example of the fiber assembly of the present invention is described with the production method thereof. The nonwoven is obtained by forming a carded web which contains the latently crimpable conjugate fibers in an amount of not less than 20 mass % and then subjecting the carded web to a thermal treatment so as to develop the latent crimps. Another fiber may be mixed with or laminated on the latently crimpable conjugate fiber in the nonwoven. As the another fiber, one or more fibers may be selected from a natural fiber such as cotton, silk, wool, hemp and pulp; a regenerated fiber such as rayon and cupraammonium rayon (Cupra); and a synthetic fiber such as an acrylic fiber, a polyester fiber, a polyamide fiber, a polyolefin fiber and a polyurethane fiber, depending on use and so on of the nonwoven.

As the carded web employed for producing the nonwoven, a parallel-laid web, a semirandom-laid web, a random-laid web, a cross-laid web and a crisscross-laid web are exemplified. Two or more different types of fiber webs may be laminated. Further, the fiber web may be subjected to a secondary process such as a needle punching treatment or a hydroentangling treatment before and/or after the thermal treatment in order to entangle fibers, if necessary. Particularly, a technique of entangling the constituent fibers three-dimensionally, such as the needle punching treatment and the hydroentangling treatment, is preferable since high elongation recovery is realized thanks to moderate constraint of the fibers when the three-dimensional crimps are developed by the thermal treatment as described below.

The fiber web is subjected to the thermal treatment by a conventional thermal treatment method. At least one thermal treatment technique selected from a hot air-through technique and a thermocompression bonding technique is preferably used as the thermal treating method. The condition for the thermal treatment technique, such as a thermal treatment temperature, may be appropriately selected depending on the employed thermal treatment technique. For example, when the hot air-through technique is employed, the thermal treatment temperature is set at a temperature at which the three-dimensional crimps of the latently crimpable conjugate fiber are developed and preferably a temperature in a range of 90° C. to 130° C., and more preferably a temperature in a range of 100° C. to 120° C.

The resultant nonwoven is bulky, and excellent in shrinkability and stretchability, and has softness. Therefore, the nonwoven is suitably used for a sanitary material such as a diaper; a medical material such as a cataplasm and a bandage; a wet tissue, a wiper, a cushioning material, a packaging material, and a sponge-like nonwoven material.

The fiber assembly, particularly the nonwoven of the present invention may be a thermally bonded nonwoven wherein the first component of the latently crimpable conjugate fiber of the present invention thermally bonds. Alternatively, the fiber assembly of the present invention is suitable for constituting a laminate, by stacking the fiber assemblies or the fiber assembly on another sheet material (for example, a paper) and then integrating them through a thermal process such as heat sealing or embossing. The fiber assembly of the present invention does not further shrink and therefore does not give crease or break during the thermal process since the latently crimpable conjugate fiber almost completely develops the crimps in the fiber assembly.

EXAMPLE

Hereinafter, the present invention is specifically described by examples. In the following examples, the melting point $T_1$ of a first component employed and the melting point $T_2$ of a second component employed, the after-spinning melting point $Tf_1$ of the first component, the single fiber strength and rupture elongation, the number of crimp, the percentage of crimp, the single fiber dry heat shrinkage percentage, the area shrinkage percentage of a nonwoven, uniformity and processability of the nonwoven were determined as described below.

[Determination of $T_1$ and $T_2$]

A differential scanning calorimeter (manufactured by Seiko Instruments Inc.) was employed. A sample amount was 5.0 mg. The sample was maintained at 200° C. for 5 minutes, and cooled to 40° C. at a temperature falling speed of 10° C./min and then melted at a temperature rising speed of 10° C./min so that a curve for heat of fusion was obtained for each of the first component and the second component. From the curve for heat of fusion, the melting points $T_1$ and $T_2$ were determined.

[Determination of $Tf_1$ and $Tf_2$]

A differential scanning calorimeter (manufactured by Seiko Instruments Inc.) was employed. A sample amount was 6.0 mg. The temperature of fiber was risen from a room temperature to 200° C. at a temperature rising speed of 10° C./min to be melted, and $Tf_1$ and $Tf_2$ were determined from a resultant curve for heat of fusion

[Tensile Strength and Rupture Elongation]

A load and an elongation when the fiber broke were measured according to JIS-L-1015 using an extension tensile tester with a sample gage length of 20 mm and they were determined as the single fiber strength and the single fiber rupture elongation respectively.

[Number of Crimp, and Percentage of Crimp]

They were determined according to JIS-L-1015.

[Single Fiber Dry Heat Shrinkage Percentage]

Dry heat shrinkage percentages were determined according to JIS-L-1015 with a gage length of 100 mm at a treatment temperature of 100° C. for a treatment time of 15 minutes under an initial tension of 0.018 mN/dtex (2 mg/d) and 0.450 mN/dtex (50 mg/d) respectively. Further, a dry heat shrinkage percentage was determined similarly at a treatment temperature of 120° C. under an initial load of 0.450 mN/dtex.

[Web-Area Shrinkage Percentage]

The web-area shrinkage percentage was determined by the following method.

(1) A carded web having a mass per unit area of about 30 g/m$^2$ was prepared using a semirandom carding machine and it was cut into a square with a size of 20 cm in the lengthwises direction×20 cm in a cross direction. The size (cm) of the web before treatment was determined.

(2) The carded web was subjected to a thermal treatment without being restricted in order to be shrunk, at a thermal treatment temperature of 100° C. and an air flow rate of 1.5 m/sec (upper flow) using a hot air-through thermal treatment machine. The thermal treatment time was set at 12 seconds.

(3) The size (cm) of the web after the treatment was determined.

(4) The area shrinkage percentage was calculated based on a following formula:

$$\text{Web-Area } \textit{shrinkage percentage } (\%) = \frac{(\text{Before-shrinking } \textit{lengthwisesize} \times \text{cross-}\textit{directionsize}) - (\text{After-}\textit{shrinkinglengthwisesize} \times \text{cross-}\textit{directionsize})}{\text{Before-}\textit{shrinkinglengthwisesize} \times \text{cross-}\textit{directionsize}} \times 100$$

Further, a change of the lengthwise size between before and after shrinking was divided by the before-shrinking lengthwise size and the quotient was multiplied by 100 to give a percentage of lengthwise size change. Similarly, a percentage of cross-direction size change was determined. From these resultant values, the ratio of percentage of the cross-direction size to the percentage of lengthwise size change was calculated.

[Processability]

A roller-type carding machine was used. A carded web having a mass per unit area of about 15 g/m$^2$ was discharged at a line speed of 80 m/min and uniformity of the carded web, and presence or absence of fly, static electricity and winding were observed and processability was evaluated according to the following criteria:

○: Favorable as to all of the uniformity of the carded web, fly, static electricity and winding;

Δ: Bad as to one of the uniformity of the web, fly, static electricity and winding; and x: Bad as to two or more of the uniformity of the web, fly, static electricity and winding.

[Sample 1]

A mixture wherein two types of LLDPE 1 and LLDPE 2 which were polymerized using a metallocene catalyst were mixed at a mass ratio of 5:5 was used as a sheath component (a first component). Here, LLDPE 1 was an LLDPE which had a melting point of 118° C., a density of 0.918 g/cm$^3$, an MI of 4 g/10 min, and a Q value of 2.6, and contained hexene-1 as an α-olefin in an amount of 3.1 mol % (trade name: UMERIT EX3335 manufactured by Ube Industries Ltd.). LLDPE2 was an LLDPE which had a melting point of 118° C., a density of 0.918 g/cm$^3$, an MI of 10 g/10 min, and a Q value of 2.6, and contained hexene-1 as an α-olefin in an amount of 3.1 mol % (trade name: UMERIT EX3322 manufactured by Ube Industries Ltd.). The MI of the first component as a whole became 7 g/10 min as a result of mixing. A polypropylene which had a melting point of 164° C., an MFR of 30 g/10 min, and a Q value of 3.0 was used as a core component (a second component) (manufactured by Japan Polypropylene Corporation, trade name: SA03D). These two components were melted and extruded using an eccentric sheath-core composite nozzle at a sheath-component spinning temperature of 250° C. and a core-component spinning temperature of 270° C. The composite ratio (volume ratio) of first component/second component was 5/5. As a result, a spun filament having an eccentricity of 42% and a fineness of 6.7 dtex was obtained.

The spun filament was drawn in hot water of 90° C. with a draw ratio of 3.8 times to give a drawn filament having a fineness of 2.2 dtex. Next, a fiber treatment agent was applied to the drawn filament and mechanical crimps were formed in the filament with a stuffing box type crimper. Then, the filament in a relaxed state was subjected to an annealing treatment and a drying treatment at the same time for 15 minutes, in a hot air-through thermal treatment machine wherein a temperature was set at 65° C. The filament was then cut into a fiber length of 51 mm and a latently crimpable conjugate fiber in form of a staple fiber was obtained.

[Sample 2]

A latently crimpable conjugate fiber was produced under the condition shown in Table 1 according to the same procedures as those employed in the production of Sample 1, using, as the sheath component, only LLDPE 1 which was used for producing Sample 1.

[Sample 3]

A latently crimpable conjugate fiber was produced under the condition shown in Table 1 according to the same procedures as those employed in the production of Sample 1, using, as the sheath component, only LLDPE 2 which was used for producing Sample 1.

[Sample 4]

A latently crimpable conjugate fiber was produced under the condition shown in Table 1 according to the same procedures as those employed in the production of Sample 1, using only LLDPE 1 which was used for producing Sample 1 as the sheath component and polypropylene 2 (SA2D manufactured by Japan Polypropylene Corporation) having a melting point of 164° C., an MFR of 15 g/10 min and a Q value of 3.0 as the core component.

[Sample 5]

LLDPE 3 (trade name: Karnel KF-480 manufactured by Japan Polyethylene Corporation) was used as the sheath component, which was an LLDPE that contained hexene-1 as the α-olefin in an amount of 2.8 mol %, and had a melting point of 109° C., a density of 0.918 g/cm$^3$, an MI of 4 g/10 min and a Q value of 2.2 and was polymerized using a metallocene catalyst. The polypropylene 2 used in the production of Sample 5 was used as the core component. A latently crimpable conjugate fiber was produced under the condition shown in Table 1, according to the same procedures as those employed in the production of Sample 1.

[Sample 6]

LLDPE 4 (trade name: UMERIT ZM064 manufactured by Ube Industries Ltd.) was used as the sheath component, which was an LLDPE that contained hexene-1 as the α-olefin in an amount of 3.5 mol %, had a melting point of 120° C., a density of 0.918 g/cm$^3$, an MI of 7 g/10 min and a Q value of 2.9 and was polymerized using a metallocene catalyst. A latently crimpable conjugate fiber was produced under the condition shown in Table 2, according to the same procedures as those employed in the production of Sample 1.

[Sample 7]

LLDPE 5 (trade name: Harmorex NH725A manufactured by Japan Polyethylene Corporation) was used as the sheath component, which was provided as a mixture of an LLDPE that contained hexene-1 as the α-olefin in an amount of 4.8 mol %, had a melting point of 120° C., a density of 0.929 g/cm$^3$, an MI of 9 g/10 min and a Q value of 7.0 and was polymerized using a metallocene catalyst and an LLDPE that was polymerized using a Ziegler-Natta catalyst. A latently crimpable conjugate fiber was produced under the condition shown in Table 2, according to the same procedures as those employed in the production of Sample 1.

[Sample 8]

LLDPE 6 (trade name: Sumikathene GA801, manufactured by Sumitomo Chemical Co., Ltd.) was used as the sheath component, which had a melting point of 124° C., a density of 0.920 g/cm$^3$, an MI of 20 g/10 min and a Q value of 4.0 and was polymerized using a metallocene catalyst. A latently crimpable conjugate fiber was produced under the condition shown in Table 2, according to the same procedures as those employed in the production of Sample 1.

[Sample 9]

LLDPE 7 (trade name: UMERIT EX3224 manufactured by Ube Industries Ltd.) was used as the sheath component, which was an LLDPE that contained hexane-1 as the α-ethylene, had a melting point of 118° C., a density of 0.918 g/cm$^3$, an MI of 20 g/10 min and a Q value of 2.6 and was polymerized using a metallocene catalyst. A latently crimpable conjugate fiber was produced under the condition shown in Table 2, according to the same procedures as those employed in the production of Sample 1.

[Sample 10]

A mixture of LLDPE 1 and LLDPE 2 which was the same as that used in the production of Sample 1 was used as the sheath component, and a polyethylene terephthalate (trade name: T200E manufactured by Toray Industries, Inc.) having a melting point of 250° C. and an intrinsic viscosity (IV value) of 0.64 was used as the core component. A latently crimpable conjugate fiber was produced under the condition shown in Table 2, according to the same procedures as those employed in the production of Sample 1.

[Sample 11]

LLDPE 4 which was used in the production of Sample 7 was used as the sheath component. A mixture was used as the core component, in which the polyethylene terephthalate (trade name: T200E manufactured by Toray Industries, Inc.) having a melting point of 250° C. and an intrinsic viscosity (IV value) of 0.64 and a polybutylene terephthalate (trade name: DURANEX 500FP manufactured by Polyplastics Co., Ltd.) having a melting point of 224° C. and an intrinsic viscosity (IV value) of 0.875 were mixed at a mass ratio of 5:5. Using these two components, a latently crimpable conjugate fiber was produced under the condition shown in Table 2, according to the same procedures as those employed in the production of Sample 1.

[Sample 12]

LLDPE 4 which was used in the production of Sample 7 was used as the sheath component. A mixture was used as the core component, in which the polyethylene terephthalate (trade name: T200E manufactured by Toray Industries, Inc.) having a melting point of 250° C. and an intrinsic viscosity (IV value) of 0.64 and a polybutylene terephthalate (trade name: DURANEX 300FP manufactured by Polyplastics Co., Ltd.) having a melting point of 224° C. and an intrinsic viscosity (IV value) of 0.69 were mixed at a mass ratio of 5:5. Using these two components, a latently crimpable conjugate fiber was produced under the condition shown in Table 2, according to the same procedures as those employed in the production of Sample 1.

[Sample 13]

A high density polyethylene (trade name: HE481 manufactured by Japan Polyethylene Corporation) was used as the sheath component, which had a melting point of 129° C., a density of 0.956 g/cm$^3$, an MI of 12 g/10 min and a Q value of 5.6 and was polymerized using a Ziegler-Natta catalyst. A polypropylene (SA1H manufactured by Japan Polypropylene Corporation) which had a melting point of 164° C. and an MFR of 26 g/10 min was used as the core component. A latently crimpable conjugate fiber was produced under the condition shown in Table 3, according to the same procedures as those employed in the production of Sample 1.

[Sample 14]

A latently crimpable conjugate fiber was produced under the condition shown in Table 3, according to the same procedures as those employed in the production of Sample 13 except that the setting temperature of the hot air-through thermal treatment machine (that is, the temperature of the annealing and the drying treatment) was 60° C.

[Sample 15]

A latently crimpable conjugate fiber was produced under the condition shown in Table 3, according to the same procedures as those employed in the production of Sample 1 except that the high-density polyethylene which was used in the production of Sample 13 was used as the sheath component and the polyethylene terephthalate which was used in the production of Sample 10 as the core component.

[Sample 16]

A latently crimpable conjugate fiber was produced under the condition shown in Table 3, according to the same procedures as those employed in the production of Sample 15 except that the setting temperature of the hot air-through thermal treatment machine (that is, the temperature of the annealing and the drying treatment) was 60° C.

[Sample 17]

A latently crimpable conjugate fiber was produced under the condition shown in Table 3, according to the same procedures as those employed in the production of Sample 1 except that LLDPE 6 which was employed in the production of Sample 8 was used as the sheath component.

[Sample 18]

A latently crimpable conjugate fiber was produced under the condition shown in Table 3, according to the same procedures as those employed in the production of Sample 1 except that LLDPE 7 which was employed in the production of Sample 9 was used as the sheath component.

The properties of the staple fibers obtained as Samples 1 to 18 are shown in Tables 1 to 3.

TABLE 1

| | | Sample 1 | Sample 2 | Sample 3 | Sample 4 | Sample 5 |
|---|---|---|---|---|---|---|
| Sheath component | Polymer | LLDPE1/ LLDPE2 | LLDPE1 | LLDPE2 | LLDPE1 | LLDPE3 |
| | Density (g/cm3) | 0.918 | 0.918 | 0.918 | 0.918 | 0.918 |
| | MI (g/10 min) | 7 | 4 | 10 | 4 | 4 |
| | Q value | 2.6 | 2.6 | 2.6 | 2.6 | 2.2 |
| | Melting point (T1) (° C.) | 118 | 118 | 118 | 118 | 109 |
| | Melting point (Tf1) (° C.) | 116 | 117 | 117 | 118 | 113 |
| Core component | Polymer | PP1 | PP1 | PP1 | PP2 | PP2 |
| | MFR (g/10 min) or IV | 30 | 30 | 30 | 15 | 15 |
| | Q value | 3 | 3 | 3 | 3 | 3 |
| | Melting point (T2) (° C.) | 164 | 164 | 164 | 164 | 164 |
| | Melting point (Tf2) (° C.) | 169 | 170 | 170 | 170 | 170 |
| Difference of MI (MFR of core component-MI of sheath component) | | 23 | 26 | 20 | 11 | 11 |
| Eccentric form | Eccentricity (%) | 42 | 35 | 40 | 42 | 42 |
| Production conditions | Spinning temperature (Sheath/Core) (° C./° C.) | 250/270 | 250/270 | 250/270 | 250/270 | 250/270 |
| | Fineness of spun filament (dtex) | 6.7 | 6.7 | 6.7 | 6.7 | 6.7 |
| | Drawing temp. (° C.) | 90 | 95 | 95 | 95 | 95 |
| | Draw ratio (times) | 3.8 | 3.8 | 3.8 | 3.8 | 3.8 |
| | Annealing/drying temp. (° C.) | 65 | 60 | 60 | 60 | 60 |
| | Fiber length (mm) | 51 | 51 | 51 | 51 | 51 |
| Single fiber properties | Finness (dtex) | 2.2 | 2.0 | 2.2 | 2.2 | 2.4 |
| | Strength (cN/dtex) | 5.3 | 5.9 | 3.8 | 6.0 | 4.3 |
| | Elongation (%) | 30.0 | 31.7 | 55.0 | 53.0 | 63.4 |
| | Number of crimps (peaks/25 mm) | 15.3 | 12.5 | 16.2 | 17.1 | 16.3 |
| | Percentage of crimps (%) | 11.3 | 8.1 | 10.7 | 12.6 | 10.6 |
| Single fiber dry heat shrinkage percentage | Initial tension 0.018 mN/dtex (%) | 87.8 | 84.2 | 83.2 | 86.9 | 85.8 |
| | Initial tension 0.450 mN/dtex (%) | 30.3 | 23.6 | 17.9 | 25.4 | 23.5 |
| | 120° C. Initial tension 0.450 mN/dtex (%) | 86.8 | 90.2 | 83.3 | 89.3 | 86.8 |
| Nonwoven properties | Mass per unit area (g/m2) | 30 | 30 | 30 | 30 | 30 |
| | Web area shrinkage percentage (%) | 91.6 | 85.9 | 86.2 | 90.6 | 92.2 |
| | MD shrinkage percentage (%) | 78.6 | 74.0 | 74.9 | 78.6 | 81.8 |
| | CD shrinkage percentage (%) | 56.2 | 45.8 | 44.9 | 56.2 | 57.0 |

TABLE 1-continued

| | Sample 1 | Sample 2 | Sample 3 | Sample 4 | Sample 5 |
|---|---|---|---|---|---|
| Ratio of shrinkage percentage (CD/MD) | 0.72 | 0.62 | 0.60 | 0.72 | 0.70 |
| Processability | ○ | ○ | ○ | ○ | ○ |

LLDPE1 = UMERIT EX3335 manufactured by Ube Industrial Ltd.
LLDPE2 = UMERIT EX3322 manufactured by Ube Industrial Ltd.
LLDPE3 = Karnel KF-480 manufactured by Japan Polyethylene Corporation
PP1 = SA03D manufactured by Japan Polypropylene Corporation
PP2 = SA02D manufactured by Japan Polypropylene Corporation

TABLE 2

| | | Sample 6 | Sample 7 | Sample 8 | Sample 9 | Sample 10 | Sample 11 | Sample 12 |
|---|---|---|---|---|---|---|---|---|
| Sheath component | Polymer | LLDPE4 | LLDPE5 | LLDPE6 | LLDPE7 | LLDPE1/ LLDPE2 | LLDPE4 | LLDPE4 |
| | Density (g/cm3) | 0.918 | 0.929 | 0.92 | 0.918 | 0.918 | 0.918 | 0.918 |
| | MI (g/10 min) | 7 | 9 | 20 | 20 | 7 | 7 | 7 |
| | Q value | 2.9 | 7 | 4 | 2.6 | 2.6 | 2.9 | 2.9 |
| | Melting point (T1) (° C.) | 120 | 120 | 124 | 118 | 118 | 120 | 120 |
| | Melting point (Tf1) (° C.) | 116 | 118 | 112 | 115 | 117 | 115 | 115 |
| Core component | Polymer | PP1 | PP1 | PP1 | PP1 | PET1 | PET1(5)/ PBT1(5) | PET1(5)/ PBT2(5) |
| | MFR (g/10 min) or IV | 30 | 30 | 30 | 30 | IV = 0.64 | IV = 0.64/ 0.875 | IV = 0.64/ 0.69 |
| | Q value | 3 | 3 | 3 | 3 | — | — | — |
| | Melting point (T2) (° C.) | 164 | 164 | 164 | 164 | 250 | 250/224 | 250/224 |
| | Melting point (Tf2) (° C.) | 171 | 166 | 169 | 168 | 254 | 254/228 | 254/228 |
| Difference of MI (MFR of core component-MI of sheath component) | | 23 | 21 | 10 | 10 | — | — | — |
| Eccentric form | Eccentricity (%) | 42 | 42 | 40 | 40 | 40 | 42 | 42 |
| Production conditions | Spinning temperature (Sheath/Core) (° C./° C.) | 250/270 | 250/270 | 250/270 | 250/270 | 250/300 | 270/300 | 270/300 |
| | Fineness of spun filament (dtex) | 6.7 | 6.7 | 6.7 | 6.7 | 6.7 | 6.0 | 6.0 |
| | Drawing temp. (° C.) | 90 | 95 | 95 | 95 | 80 | 80 | 80 |
| | Draw ratio (times) | 3.8 | 3.8 | 3.8 | 3.8 | 3.4 | 2.6 | 2.6 |
| | Annealing/drying temp. (° C.) | 65 | 60 | 60 | 60 | 60 | 60 | 60 |
| | Fiber length (mm) | 51.0 | 51.0 | 51.0 | 51.0 | 51 | 51 | 51.0 |
| Single fiber properties | Finness (dtex) | 2.2 | 2.2 | 2.2 | 2.2 | 2.4 | 2.9 | 2.7 |
| | Strength (cN/dtex) | 5.2 | 3.8 | 2.5 | 2.4 | 2.4 | 1.5 | 1.5 |
| | Elongation (%) | 33.9 | 45.5 | 114.0 | 84.2 | 56.5 | 85.9 | 81.3 |
| | Number of crimps (peaks/25 mm) | 15.8 | 15.6 | 14.2 | 15.6 | 13.3 | 16.7 | 16.3 |
| | Percentage of crimps (%) | 11.0 | 11.3 | 10.6 | 11.3 | 8.2 | 12.1 | 12.0 |
| Single fiber dry heat shrinkage percentage | Initial tension 0.018 mN/dtex (%) | 82.2 | 80.4 | 54.3 | 64.8 | 59.3 | 58.0 | 65.9 |
| | Initial tension 0.450 mN/dtex (%) | 30.8 | 23.7 | 18.5 | 20.0 | 16.4 | 21.6 | 23.4 |
| | 120° C. Initial tension 0.450 mN/dtex (%) | 82.2 | 79.7 | 64.9 | 60.9 | 35.0 | 58.0 | 60.9 |
| Nonwoven properties | Mass per unit area (g/m2) | 30 | 30 | 30 | 30 | 30 | 30 | 30 |
| | Web area shrinkage percentage (%) | 91.0 | 82.1 | 87.3 | 89.9 | 80.6 | 87.9 | 88.5 |
| | MD shrinkage percentage (%) | 77.0 | 70.3 | 77.0 | 79.6 | 73.8 | 77.4 | 79.0 |
| | CD shrinkage percentage (%) | 62.1 | 39.7 | 42.8 | 48.5 | 41.6 | 45.6 | 46.0 |
| | Ratio of shrinkage percentage (CD/MD) | 0.81 | 0.56 | 0.56 | 0.61 | 0.56 | 0.59 | 0.58 |
| | Processability | ○ | Δ | ○ | ○ | ○ | ○ | ○ |

LLDPE4 = UMERIT ZM064 manufactured by Ube Industries Ltd.
LLDPE5 = Harmorex NH725A manufactured by Japan Polyethylene Corporation
LLDPE6 = Sumikathene GA801 manufactured by Sumitomo Chemical Co., Ltd.
LLDPE7 = UMERIT EX3224 manufactured by Ube Industries Ltd.
PP1 = SA03D manufactured by Japan Polypropylene Corporation
PET1 = T200E manufactured by Toray Industries, Inc.
PBT1 = DURANEX 500FP manufactured by Polyplastics Co., Ltd.
PBT2 = DURANEX 300FP manufactured by Polyplastics Co., Ltd.

TABLE 3

| | | Sample 13 | Sample 14 | Sample 15 | Sample 16 | Sample 17 | Sample 18 |
|---|---|---|---|---|---|---|---|
| Sheath component | Polymer | HDPE1 | HDPE1 | HDPE1 | HDPE1 | LLDPE6 | LLDPE7 |
| | Density (g/cm3) | 0.956 | 0.956 | 0.956 | 0.956 | 0.92 | 0.918 |
| | MI (g/10 min) | 12 | 12 | 12 | 12 | 20 | 20 |
| | Q value | 5.6 | 5.6 | 5.6 | 5.6 | 4 | 2.6 |
| | Melting point (T1) (° C.) | 129 | 129 | 129 | 129 | 124 | 118 |
| | Melting point (Tf1) (° C.) | 132 | 132 | 132 | 132 | 112 | 115 |

TABLE 3-continued

| | | Sample 13 | Sample 14 | Sample 15 | Sample 16 | Sample 17 | Sample 18 |
|---|---|---|---|---|---|---|---|
| Core component | Polymer | PP3 | PP3 | PET1 | PET1 | PP1 | PP1 |
| | MFR (g/10 min) or IV | 26 | 26 | IV = 0.64 | IV = 0.64 | 30 | 30 |
| | Q value | 6 | 6 | — | — | 3 | 3 |
| | Melting point (T2) (° C.) | 164 | 164 | 250 | 250 | 164 | 164 |
| | Melting point (Tf2) (° C.) | 170 | 170 | 264 | 264 | 169 | 168 |
| | Difference of MI ("MFR of core component" – "MI of sheath component") | 14 | 14 | — | — | 10 | 10 |
| Eccentric form | Eccentricity (%) | 40 | 40 | 40 | 40 | 35 | 35 |
| Production conditions | Spinning temperature (Sheath/Core) (° C./° C.) | 280/280 | 280/280 | 250/300 | 250/300 | 250/270 | 250/270 |
| | Fineness of spun filament (dtex) | 6.7 | 6.7 | 6.7 | 6.7 | 6.7 | 6.7 |
| | Drawing temp. (° C.) | 60 | 60 | 80 | 80 | 95 | 95 |
| | Draw ratio (times) | 3.6 | 3.6 | 3.4 | 3.4 | 3.8 | 3.8 |
| | Annealing/drying temp. (° C.) | 100 | 60 | 100 | 60 | 60 | 60 |
| | Fiber length (mm) | 51 | 51 | 51 | 51 | 51.0 | 51.0 |
| Single fiber properties | Finness (dtex) | 2.3 | 2.2 | 2.4 | 2.3 | 2.2 | 2.2 |
| | Strength (cN/dtex) | 4.5 | 4.3 | 3.1 | 3.0 | 2.7 | 3.1 |
| | Elongation (%) | 80.3 | 85.4 | 63.4 | 68.1 | 157.0 | 121.2 |
| | Number of crimps (peaks/25 mm) | 22.2 | 17.1 | 20.1 | 16.6 | 12.1 | 15.1 |
| | Percentage of crimps (%) | 18.3 | 14.1 | 18.0 | 13.8 | 10.1 | 11.0 |
| Single fiber dry heat shrinkage percentage | Initial tension 0.018 mN/dtex (%) | ▲4.3 | 38 | ▲2.3 | 33.7 | 27.6 | 35.2 |
| | Initial tension 0.450 mN/dtex (%) | ▲0.1 | 5.5 | ▲0.8 | 12.6 | 5.4 | 9.6 |
| | 120° C. Initial tension 0.450 mN/dtex (%) | 2.7 | 25.7 | 0.6 | 17.3 | 7.8 | 23.3 |
| Nonwoven properties | Mass per unit area (g/m2) | 30 | 30 | 30 | 30 | 30 | 30 |
| | Web area shrinkage percentage (%) | 19.3 | 44.8 | 16.9 | 37.0 | 59.1 | 79.4 |
| | MD shrinkage percentage (%) | 15.4 | 35 | 12.5 | 30 | 55.0 | 70.4 |
| | CD shrinkage percentage (%) | 5.6 | 15 | 5.1 | 10 | 12.2 | 30.7 |
| | Ratio of shrinkage percentage (CD/MD) | 0.25 | 0.43 | 0.41 | 0.33 | 0.22 | 0.44 |
| | Processability | X | ○ | X | ○ | ○ | ○ |

HDPE1 = HE481 manufactured by Japan Polyethylene Corporation
LLDPE6 = Sumikathene GA801 manufactured by Sumitomo Chemical Co., Ltd.
LLDPE7 = UMERIT EX3224 manufactured by Ube Industries Ltd.
PP1 = SA03D manufactured by Japan Polypropylene Corporation
PP3 = SA1H manufactured by Japan Polypropylene Corporation
PET1 = T200E manufactured by Toray Industries, Inc.

Any of the latently crimpable conjugate fibers of Samples 1 to 12 exhibited a high single fiber dry heat shrinkage percentage and achieved a high web-area shrinkage percentage of web at a low temperature (100° C.). Especially, any of the fibers of Samples 1 to 6 had a single fiber dry heat shrinkage percentage of greater than 80% under the initial tension of 0.018 mN/dtex, achieved a ratio of web shrinkage percentage of not less than 0.6 and developed favorable spiral crimps. It is considered that these good results were obtained because the sheath component was formed using a linear low-density polyethylene which had an MI of not greater than 15 and a Q value of less than 3 and was polymerized with a metallocene catalyst as the ethylene-α-olefin copolymer and the core component was formed using PP.

The fiber of Sample 7 had a single fiber dry heat shrinkage percentage of greater than 80% under the initial tension of 0.018 mN/dtex, but the ratio of web shrinkage percentage was below 0.6, and the crimp-developing property of this fiber was inferior than that of Sample 1 and so on. It was, however, observed that the fiber of Sample 7 exhibited a large single fiber dry heat shrinkage percentage which was measured at 120° C. under an initial tension of 0.450 mN/dtex and developed crimps well at 120° C. Therefore, the fiber of Sample 7 was sufficiently practical to use by being treated at a temperature between 110° C. and 120° C. The same is applicable to Samples 8 and 9.

Also as to Samples 10, 11 and 12 wherein the polyester resin was the core component, a single fiber dry heat shrinkage percentage under the initial tension of 0.018 mN/dtex was not so high as that of Sample 1, but it exceeds 50%. Further, Samples 11 and 12 had a large single fiber dry heat shrinkage percentage at 120° C. under the initial tension of 0.450 mN/dtex and they were sufficiently practical to use as the latently crimpable conjugate fiber treated at a temperature between about 110° C. and about 120° C. Samples 11 and 12 wherein a mixture of PET and PBT was used had a larger web-area shrinkage percentage and a larger ratio of web shrinkage percentage and developed favorable crimps compared with Sample 10 wherein only the PET was used.

The conjugate fibers of Samples 13 and 15 were inferior in cardability since the number of crimp and the percentage of crimp were large and the three-dimensional crimps were partially developed at the fiber-making stage. Further the conjugate fibers of Samples 13 and 15 exhibits a single fiber dry heat shrinkage percentage of a minus value and revealed a low area shrinkage percentage. Annealing (drying) temperature in the production of the conjugate fibers of Samples 14 and 16 was low, i.e. 60° C. in order to suppress the development of three-dimensionally crimps, and these fibers showed favorable cardability since the three-dimensional crimp developing was suppressed at the fiber making stage. Any of these fibers, however, revealed a low web-area shrinkage percentage. It is considered that although the fibers of Samples 17 and 18 were produced using the same sheath component and the core component as those of Samples 8 and 9 respectively, favorable crimps could not be developed since the eccentricity was small. From this, it is considered that LLDPE 6 and LLDPE 7 used for producing Samples 17 and 18 were inferior in shrinkability compared to LLDPE 1 to LLDPE 5 used for producing the other samples because the MI of each of LLD- PEs 6 and 7 was higher than those of LLDPEs 1 to 5, whereby the slight change in eccentricity affected the crimp developing.

INDUSTRIAL APPLICABILITY

The latently crimpable conjugate fiber of the present invention develops crimps and has a thermal adhesiveness at a low temperature because a specific LLDPE having a thermal shrinkability and a thermal adhesiveness is used, and therefore, the fiber is useful for producing a bulky fiber assembly (particularly a nonwoven) having softness which can be thermally adhered to another sheet.

The invention claimed is:

1. A latently crimpable conjugate fiber, comprising:

a conjugate fiber that includes a first component comprising, as a thermal shrinkable component, a linear low-density polyethylene, the first component having a before-spinning melt index in a range of 1 g/10 min to 15 g/10 min, a ratio of a weight-average molecular weight (Mw) to a number average molecular weight (Mn) (a Q value) in range of 1.5 to 8 and a density in a range of 0.90 g/cm$^3$ to 0.93 g/cm$^3$, and a second component that is formed from a thermal plastic polymer, the second component having an after-spinning melting point $TF_2$ that is higher than an after-spinning melting point $TF_1$ of the first component, wherein a surface of the first component is exposed with an exposed length viewed in cross section of not less than 20% relative to a peripheral length of the fiber, wherein the fiber has: (1) a monofilament dry heat shrinkage percentage of not less than 50%, which is determined according to JIS-L-1015 (dry heat shrinkage percentage) at a temperature of 100° C. under an initial tension of 0.018 mN/dtex (2 mg/d) for a time of 15 minutes; and (2) a monofilament dry heat shrinkage percentage of not less than 15%, which is determined according to JIS-L-1015 (dry heat shrinkage percentage) at a temperature of 100° C. under an initial tension of 0.450 mN/dtex (50 mg/d) for a time of 15 minutes.

2. The latently crimpable conjugate fiber according to claim 1, wherein a section of the conjugate fiber is (1) an eccentric sheath-core section wherein the first component is a sheath component and the second component is a core component and a center position of the second component is shifted from a center position of the fiber, or (2) a side-by-side section.

3. The latently crimpable conjugate fiber according to claim 1, wherein the liner low-density polyethylene is a resin polymerized with a metallocene catalyst.

4. The latently crimpable conjugate fiber according to claim 1, wherein the after-spinning temperature $TF_1$ of the first component is in a range of 105° C. to 125° C.

5. The latently crimpable conjugate fiber according to claim 1, wherein the ratio of the weight-average molecular weight (Mw) to number average molecular weight (Mn) of the linear low-density polyethylene is in a range of 1.5 to 3.5.

6. A fiber assembly which comprises the latently-crimpable conjugate fibers according to claim 1 in an amount of not less than 20 mass % and the latently crimps have been developed in the latently crimpable conjugate fibers.

7. A nonwoven which comprises the latently-crimpable conjugate fibers according to claim 1 in an amount of not less than 20 mass % and the latently crimps have been developed in the latently crimpable conjugate fibers.

8. A method for producing a latently crimable conjugate fiber which comprise obtaining a spun filament by composite-spinning a first component containing, as a thermal shrinkable component, a linear low-density polyethylene whose melting point $T_1$ is in a range of 100° C. to 125° C., a density is in a range of 0.90 g/cm$^3$ to 0.93 g/cm$^3$, a Q value is a range of 1.5 to 8 and a before-spinning melt index is in a range of 1 g/10 min to 15 g/10 min and a second component consisting of a thermal plastic polymer whose melting point $T_2$ is higher than the melting point $T_1$, such that they form an eccentric section of a side-by-side section and the first component is exposed with an exposed length of not less than 20% relative to the peripheral length of the fiber, drawing the filament at a temperature within a range of 60° C. to $(T_1-10)$° C. at a draw ratio of not less than 2 times, giving mechanical crimps to the drawn filament with a number of crimps in a range of 12 peaks/25 mm to 19 peaks/25 mm, and subjecting the crimped filament to an annealing treatment at a temperature in a range of 40° C. to 100° C.

* * * * *

UNITED STATES PATENT AND TRADEMARK OFFICE

CERTIFICATE OF CORRECTION

PATENT NO. : 7,670,677 B2
APPLICATION NO. : 10/569666
DATED : March 2, 2010
INVENTOR(S) : Usui et al.

It is certified that error appears in the above-identified patent and that said Letters Patent is hereby corrected as shown below:

Title page item 57

Abstract, line 11, “0.018mn/dtex” should be --0.018mN/dtex--.

Column 22, line 22, “crimable” should be --crimpable--.

Column 22, line 23, “comprise” should be --comprises--.

Column 22, line 28, “is a” should be --is in a--.

Signed and Sealed this
First Day of February, 2011

David J. Kappos

David J. Kappos
*Director of the United States Patent and Trademark Office*